US011856656B2

(12) United States Patent
Galindo Perez et al.

(10) Patent No.: US 11,856,656 B2
(45) Date of Patent: Dec. 26, 2023

(54) COOKING APPLIANCE

(71) Applicant: BSH Hausgeräte GmbH, Munich (DE)

(72) Inventors: Juan Jose Galindo Perez, Saragossa (ES); Sergio Llorente Gil, Saragossa (ES); Carlos Obon Abadia, Saragossa (ES); Jose Manuel Palacios Gasos, Saragossa (ES); Edgar Jorge Ramirez Laboreo, Saragossa (ES); Alvaro Rigual Iturria, Saragossa (ES); Fernando Sanz Serrano, Calamocha (ES); Rebeca Soria Ruiz, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 402 days.

(21) Appl. No.: 16/466,047

(22) PCT Filed: Dec. 12, 2017

(86) PCT No.: PCT/IB2017/057816

§ 371 (c)(1),
(2) Date: Jun. 3, 2019

(87) PCT Pub. No.: WO2018/116056

PCT Pub. Date: Jun. 28, 2018

(65) Prior Publication Data

US 2020/0068673 A1 Feb. 27, 2020

(30) Foreign Application Priority Data

Dec. 23, 2016 (ES) ..... ES201631677

(51) Int. Cl.
*H05B 11/00* (2006.01)
*H05B 1/02* (2006.01)
(Continued)

(52) U.S. Cl.
CPC ..... *H05B 11/00* (2013.01); *H05B 1/0202* (2013.01); *H05B 3/00* (2013.01); *H05B 6/04* (2013.01); *H05B 6/129* (2013.01)

(58) Field of Classification Search
CPC ..... H05B 11/00; H05B 1/0202; H05B 3/00
(Continued)

(56) References Cited

U.S. PATENT DOCUMENTS

2009/0250454 A1 10/2009 Egenter
2009/0294434 A1 12/2009 Fonseca et al.

FOREIGN PATENT DOCUMENTS

DE 19963079 A1 7/2001
DE 102005044466 A1 3/2007
(Continued)

OTHER PUBLICATIONS

Machine Translation of EP2506671; Aug. 2021 (Year: 2021).*
(Continued)

*Primary Examiner* — Tu B Hoang
*Assistant Examiner* — Thomas J Ward
(74) *Attorney, Agent, or Firm* — Michael E. Tschupp; Andre Pallapies; Brandon G. Braun

(57) ABSTRACT

A cooking appliance apparatus, in particular an oven apparatus, includes a muffle which defines a cooking chamber, and a heating element to heat the cooking chamber at least partially. A switching unit connects the heating element to a first supply voltage in a first operating state and to a second supply voltage in a second operating state, with the second supply voltage being different from the first supply voltage.

15 Claims, 2 Drawing Sheets

(51) Int. Cl.
*H05B 3/00* (2006.01)
*H05B 6/04* (2006.01)
*H05B 6/12* (2006.01)

(58) Field of Classification Search
USPC ..... 219/620–627
See application file for complete search history.

(56) References Cited

FOREIGN PATENT DOCUMENTS

| | | | | | |
|---|---|---|---|---|---|
| DE | 102012220324 | | * | 6/2013 | ..... H05B 6/06 |
| DE | 102012220324 | A1 | | 6/2013 | |
| EP | 0291302 | A2 | | 11/1988 | |
| EP | 1361780 | A1 | | 11/2003 | |
| EP | 2506669 | A2 | | 10/2012 | |
| EP | 2506671 | | * | 10/2012 | ..... H05B 6/06 |
| EP | 2506671 | A2 | | 10/2012 | |
| JP | S5545659 | U | | 3/1980 | |
| JP | H09245961 | A | | 9/1997 | |

OTHER PUBLICATIONS

Machine Translation of DE102012220324; Aug. 2021 (Year: 2021).*
National Search Report ES P201631677 dated Dec. 19, 2017.
International Search Report PCT/IB2017/057816 dated Mar. 7, 2018.

* cited by examiner

COOKING APPLIANCE

CROSS-REFERENCES TO RELATED APPLICATIONS

This application is the U.S. National Stage of International Application No. PCT/IB2017/057816, filed Dec. 12, 2017, which designated the United States and has been published as International Publication No. WO 2018/116056 A1 and which claims the priority of Spanish Patent Application, Serial No. P201631677, filed Dec. 23, 2016, pursuant to 35 U.S.C. 119(a)-(d).

BACKGROUND OF THE INVENTION

The invention relates to a cooking appliance apparatus and a method for operating a cooking appliance apparatus.

A cooking appliance apparatus with a muffle, which delimits a cooking chamber, is already known from the prior art. A heating element heats the cooking chamber partially in an operating state. The heating element is connected directly to a supply voltage, which is supplied by a power supply network. To increase the power that can be output by the heating element, a total resistance of a system comprising heating element and resistor is reduced, for example by connecting a number of resistors in a parallel manner. To reduce the power that can be output by the heating element, a control unit operates the heating element in a pulsed mode.

BRIEF SUMMARY OF THE INVENTION

It is the object of the invention in particular to improve a power supply to an apparatus of the type in question.

The invention is based on a cooking appliance apparatus, in particular an induction cooking appliance apparatus, advantageously an oven apparatus and particularly advantageously an induction oven apparatus, with a muffle, which defines at least one cooking chamber, and with at least one heating element, which is provided to heat the cooking chamber at least partially.

It is proposed that the cooking appliance apparatus has at least one switching unit, which is provided to connect the heating element to at least one first supply voltage in at least one first operating state and to at least one second supply voltage, which is different from the first supply voltage, in at least one second operating state.

A "cooking appliance apparatus", in particular an "induction cooking appliance apparatus", advantageously an "oven apparatus" and particularly advantageously an "induction oven apparatus", refers in particular to at least a part, in particular a module, of a cooking appliance, in particular an induction cooking appliance, advantageously an oven and particularly advantageously an induction oven. For example a cooking appliance with the cooking appliance apparatus could be configured as a grill appliance and/or a steam cooking appliance and/or a microwave appliance.

An "induction cooking appliance", in particular an "induction oven", refers in particular to a cooking appliance, in particular an oven, which has at least one inductive operating state and in addition to the inductive operating state could in particular have at least one operating state, which is different from inductive heating, for example at least one resistance-heated operating state.

The muffle in particular has at least one muffle wall, which in particular delimits the cooking chamber at least partially. In particular the muffle has at least two, in particular at least three, advantageously at least four and preferably at least five, muffle walls. The muffle wall could be for example a muffle rear wall and/or at least one muffle side wall and/or preferably at least one muffle top wall and/or preferably at least one muffle bottom wall. The muffle in particular delimits the cooking chamber at least partially and advantageously at least essentially together with at least one appliance door of the cooking appliance apparatus in at least one operating state. The cooking appliance apparatus in particular has at least one appliance door, which delimits the cooking chamber at least partially in at least one operating state. The cooking chamber is provided in particular for the introduction of items to be cooked, for example food, for heating and/or warming and/or for keeping items to be cooked warm. In particular the muffle wall is a wall delimiting the cooking chamber at one side at least.

The cooking appliance apparatus in particular has at least one cooking appliance rear wall. The cooking appliance rear wall is in particular arranged at least essentially and advantageously completely within the cooking chamber. The cooking appliance rear wall is configured in particular differently from a muffle wall configured as a muffle rear wall and is advantageously arranged in proximity to at least one muffle wall configured as a muffle rear wall.

A "heating element" in this context refers in particular to an element, which is provided to convert energy, preferably electrical energy, to heat and to supply it in particular to at least one object to be heated. The object to be heated could be for example at least one muffle wall of the muffle. Alternatively or additionally the object to be heated could be for example at least one cookware item present in and/or introduced into the cooking chamber.

The expression that the heating element is provided to heat the cooking chamber "at least partially" means in particular that the heating element is provided to heat the cooking chamber directly and/or indirectly. For example, in the case of direct heating of the cooking chamber in particular, the heating element could be provided to heat a fluid present within the cooking chamber. The fluid present within the cooking chamber could be for example a gas, which could be air for example, and/or a gas/fluid mixture, for example steam. The heating element could be provided for example to heat a fluid present in proximity to the heating element. The cooking appliance apparatus could have at least one fan unit for example, which could be provided in particular to distribute a fluid heated by the heating element, in particular by means of convection, within the cooking chamber and/or to introduce it into the cooking chamber.

For example, in the case of indirect heating of the cooking chamber in particular, the heating element could be provided to heat at least one cookware item present within the cooking chamber. Alternatively or additionally, in the case of indirect heating of the cooking chamber in particular, the heating element could be provided for example to heat at least one muffle wall of the muffle. In particular a muffle wall heated by the heating element could heat the cooking chamber, namely in particular by heating a fluid present within the cooking chamber, in particular air present within the cooking chamber.

A "switching unit" refers in particular to a unit, which in particular has at least one switching element and which is provided in particular to change a current conducting property and/or at least one current path, when a switching position changes. In particular the switching unit could have at least two, advantageously at least three, particularly advantageously at least four and preferably a number of switching elements, which could be arranged in particular in a switching matrix. The switching elements arranged in a switching matrix could in particular be connected next to one another and/or one after the other. A "switching matrix" refers in particular to a unit, which is defined in particular by a combination of a number of switching elements. Switching elements "connected next to one another" refer in particular to switching elements of identical hierarchy and/or rank. Switching elements "connected one after the other" refer in particular to switching elements of different hierarchy and/or rank, which are connected in particular behind one another and/or in series.

A "switching element" refers in particular to an electrical and/or electronic element, which has at least one first contact and at least one second contact, and which is provided in particular to establish and/or isolate an electrically conducting connection between the first contact and the second contact, and which has in particular at least one control contact, in addition to the first contact and the second contact, to receive a control signal. In particular the switching element can be switched by way of the control contact, it being possible for the switching element to be provided in particular to receive a control signal, in particular from at least one control unit, by means of the control contact and to change switching position as a function of the control signal. For example the switching element could be configured as a mechanical and/or electromechanical and/or electromagnetic switching element, in particular as a relay. In particular the cooking appliance apparatus has at least one control unit, which is provided in particular to actuate the switching unit, in particular the switching element of the switching unit.

The switching unit is arranged in particular in a first switching position in the first operating state and in particular in a second switching position, which is different from the first switching position, in the second operating state.

The first supply voltage and the second supply voltage differ in particular in at least one property, for example a frequency and/or a peak value of a voltage and/or a sign before a voltage and/or a phasing of a voltage.

"Provided" means in particular specifically programmed, designed and/or equipped. That an object is provided for a specific function means in particular that the object satisfies and/or performs said specific function in at least one application and/or operating state.

The inventive embodiment in particular allows a power supply to the cooking appliance apparatus to be improved. In particular a high level of operating convenience can be achieved. A high level of flexibility in particular can be achieved. In particular the heating element can be connected easily to different supply voltages, in particular allowing different power stages of the heating element to be set particularly easily. In at least one operating state the heating element can be operated in particular with increased power. In particular a high total power could be achieved in at least one operating state, allowing in particular fast heating of the cooking chamber and/or a short heating time, which could in particular be inversely proportional to an increase in total power.

It is further proposed that the first supply voltage and the second supply voltage differ at least in respect of frequency in at least one operating state. In particular the first supply voltage has a first frequency and the second supply voltage has a second frequency, which is different from the first frequency. In particular the second frequency is twice, in particular 5 times, advantageously 10 times, particularly advantageously 50 times, preferably 100 times and particularly preferably 1000 times, the size of the first frequency. In particular the cooking appliance apparatus has at least one second power supply unit, which in particular supplies the second supply voltage. This in particular allows a particularly high level of flexibility to be achieved, in particular in respect of the maximum power that can be output by the heating element.

It is also proposed that the first supply voltage is a network voltage supplied in particular from a single phase of a power supply network, in particular to a household connection. This in particular allows an optimum power supply to be achieved.

For example the second supply voltage could be a further network voltage supplied in particular from a single further phase of a power supply network in particular to a household connection, which differs in particular in at least one property from the network voltage, in particular in a voltage phasing. The cooking appliance apparatus preferably has at least one high-frequency power supply unit, which supplies the second supply voltage. In particular the supply voltage, supplied in particular by the high-frequency power supply unit, has a frequency with a value of at least 1 kHz, in particular at least 5 kHz, advantageously at least 10 kHz and particularly advantageously at least 20 kHz. For example the high-frequency supply voltage could have at least one step-up converter unit, which could be provided in particular to convert an input voltage to an output voltage, which is larger than the input voltage. The high-frequency power supply unit corresponds in particular to the second power supply unit. This allows a high power input in particular to be supplied, allowing at least one high-power unit, for example an induction heating element, in particular to be supplied.

It is further proposed that the cooking appliance apparatus has at least one further heating element, which is connected to the high-frequency power supply unit in at least one operating state. For example the further heating element could be connected to the high-frequency supply voltage indirectly, namely in particular by way of the switching unit. In particular the heating element is connected to the high-frequency supply voltage directly, in particular without intermediary and/or avoiding a switching unit and in particular solely by way of electrical resistors. The further heating element is provided in particular to heat the cooking chamber at least partially. This allows the further heating element in particular to be supplied optimally, allowing in particular an optimum cooking result and/or a high level of operating convenience.

It is also proposed that the high-frequency power supply unit has at least one inverter, which is provided to supply the further heating element, which is configured as an induction heating element. The inverter could be configured for example as a transistor, in particular as a power transistor and preferably as an IGBT. In particular the induction heating element is provided to generate an electromagnetic alternating field in particular with a frequency between 17 kHz and 150 kHz. The further heating element configured as an induction heating element is provided in particular to generate heat by means of the electromagnetic alternating field generated by the further heating element configured as an induction heating element in at least one in particular metallic, preferably ferromagnetic, object to be heated by eddy current induction and/or remagnetization effects, in particular by converting the electromagnetic alternating field to heat in the object to be heated. This allows in particular a low-cost embodiment to be achieved.

It is further proposed that the switching unit is provided to connect the heating element to a third supply voltage in at least one third operating state. In particular the third supply voltage is different from the first supply voltage. In particular the third supply voltage is different from the second supply voltage. The first supply voltage and the second supply voltage and the third supply voltage differ in particular in at least one property, for example a frequency and/or a peak value of a voltage and/or a sign before a voltage and/or a phasing of a voltage. This allows a particularly high level of flexibility to be achieved in particular.

For example the cooking appliance apparatus could have at least one high-frequency power supply unit, which could supply the third supply voltage in particular. The third supply voltage is preferably a further network voltage supplied from an in particular single further phase of a power supply network, in particular to a household connection. In particular the phase and the further phase are two different phases of the power supply network. This in particular allows a high total power to be achieved, allowing fast heating of the cooking chamber in particular.

It is also proposed that the switching unit is provided to deactivate the heating element in at least one further operating state. The switching unit in particular isolates a connection between the heating element and the supply voltages, in particular each of the supply voltages, in the further operating state. The control unit is provided in particular to operate the further heating element in the further operating state and in particular to deactivate the heating element by means of the switching unit. This allows a particularly energy-saving and/or environmentally friendly embodiment to be achieved.

It is further proposed that the heating element is configured as a resistance heating element. A "resistance heating element" in this context refers in particular to an element, which in particular has at least one electrical resistor, through which electric current flows in at least one operating state and which is provided in particular to convert energy, preferably electrical energy, to heat by means of the electrical resistor in at least one operating state, and in particular to supply said heat to at least one object to be heated. This results in a low-cost embodiment in particular.

A particularly good power supply can be achieved in particular by a cooking appliance, in particular an induction cooking appliance, advantageously an oven and particularly advantageously an induction oven, with at least one cooking appliance apparatus, in particular an induction cooking appliance apparatus, advantageously an oven apparatus and particularly advantageously an induction oven apparatus.

A power supply can be further increased in particular by a method for operating a cooking appliance apparatus, in particular an induction cooking appliance apparatus, advantageously an oven apparatus and particularly advantageously an induction oven apparatus, with a muffle, which defines at least one cooking chamber, and with at least one heating element by means of which the cooking chamber is at least partially heated in at least one operating state, the heating element being connected to at least one first supply voltage in at least one first operating state and to at least one second supply voltage, which is different from the first supply voltage, in at least one second operating state.

The cooking appliance apparatus here is not limited to the application and embodiment described above. In particular the cooking appliance apparatus can have a number of individual elements, components and units that is different from a number cited herein to bring about a mode of operation described herein.

BRIEF DESCRIPTION OF THE DRAWINGS

Further advantages will emerge from the description of the drawing which follows. The drawing shows an exemplary embodiment of the invention. The drawing, description and claims contain numerous features in combination. The person skilled in the art will expediently also consider the features individually and combine them in further useful combinations.

DETAILED DESCRIPTION OF EXEMPLARY EMBODIMENTS OF THE PRESENT INVENTION

Figure 1:
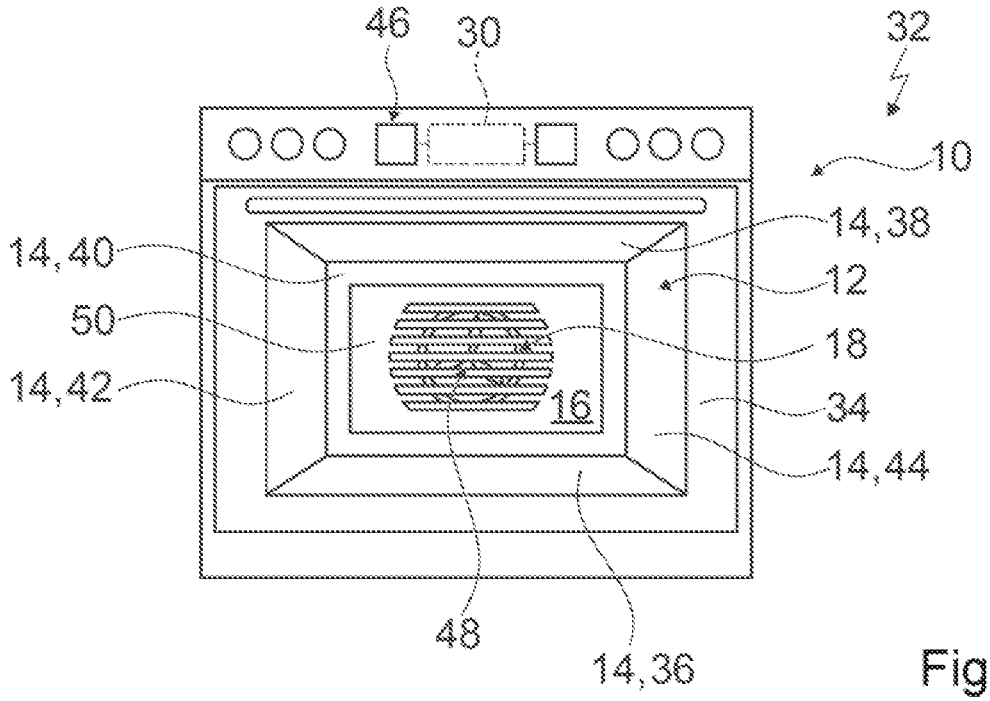
FIG. 1 shows a schematic view of a cooking appliance with a cooking appliance apparatus.

FIG. 1 shows a cooking appliance 32, which is configured as an induction cooking appliance, with a cooking appliance apparatus 10, which is configured as an induction cooking appliance apparatus. The cooking appliance 32 could be configured as a grill appliance and/or a steam cooking appliance and/or a microwave appliance for example. In the present exemplary embodiment the cooking appliance 32 is configured as an oven, namely in particular an induction oven. The cooking appliance apparatus 10 is configured as an oven apparatus, namely in particular an induction oven apparatus.

The cooking appliance apparatus 10 has a muffle 12, which defines a cooking chamber 16. The muffle 12 partially delimits the cooking chamber 16. In an operating state the muffle 12 essentially delimits the cooking chamber 16 together with a cooking appliance door 34. The cooking appliance apparatus 10 comprises the cooking appliance door 34.

The muffle 12*a* has five muffle walls 14. Where objects are present multiple times, only one is shown with a reference character in the figures. In the operating state the muffle walls 14 essentially define the cooking chamber 16 together with the cooking appliance door 34.

One of the muffle walls 14 is configured as a muffle bottom wall 36. One of the muffle walls 14 is configured as a muffle top wall 38. One of the muffle walls 14 is configured as a muffle rear wall 40. Two of the muffle walls 14 are configured as a muffle side wall 42, 44. Only one of the muffle walls 14 is described in the following.

The cooking appliance apparatus 10 has an operator interface 46 for inputting and/or selecting operating parameters (see FIG. 1), for example a heating power and/or a heating power density and/or a heating zone. The operator interface 46 is provided to output a value of an operating parameter to an operator.

The cooking appliance apparatus 10 has a control unit 30. The control unit 30 is provided to perform actions and/or change settings as a function of operating parameters input by means of the operator interface 46. In an operating state the control unit 30 regulates an energy supply to at least one heating element 18.

Figure 2:
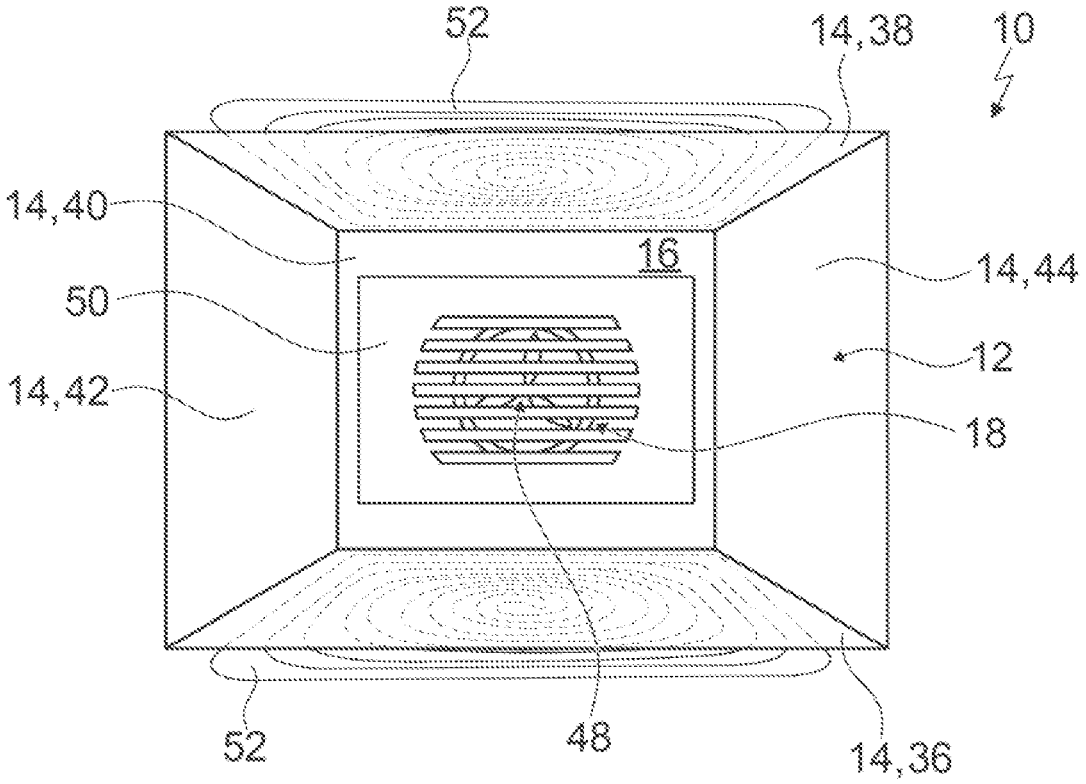
FIG. 2 shows a schematic view of a muffle delimiting a cooking chamber, a heating element, a fan unit and two further heating elements of the cooking appliance apparatus.

The cooking appliance apparatus 10 comprises the heating element 18 (see FIGS. 1 and 2). The heating element 18 is configured as a resistance heating element. In the operating state the heating element 18 is provided to heat the cooking chamber 16 partially.

In the present exemplary embodiment the cooking appliance apparatus 10 has two further heating elements 52. Alternatively the cooking appliance apparatus 10 could in particular have a different number of further heating elements 52. For example the cooking appliance apparatus 10 could have just one further heating element 52. Alternatively the cooking appliance apparatus 10 could have for example at least three, in particular at least four, advantageously at least five and preferably a number of, further heating elements 52.

In an operating state the further heating elements 52 are arranged outside the cooking chamber 16. A lower further heating element 52 of the further heating elements 52 is arranged below the muffle wall 14 configured as the muffle bottom wall 36 in its incorporated state. The lower further heating element 52 is arranged on the muffle wall 14 configured as the muffle bottom wall 36.

An upper further heating element 52 of the further heating elements 52 is arranged above the muffle wall 14 configured as the muffle top wall 38 in its incorporated state. The upper further heating element 52 is arranged on the muffle wall 14 configured as the muffle top wall 38.

Alternatively at least one further heating element 52 could be arranged on a muffle wall 14 configured as a muffle side wall 42, 44 and/or on a muffle wall 14 configured as the muffle rear wall 40. Only one of the further heating elements 52 is described in the following.

In the present exemplary embodiment the further heating element 52 is provided to heat the muffle wall 14, on which the further heating element 52 is arranged. In the present exemplary embodiment the further heating element 52 heats the muffle wall 14 inductively. The further heating element 52 is configured as an induction heating element.

The cooking appliance apparatus 10 has a fan unit 48 (see FIGS. 1 and 2). The fan unit 48 has a fan wheel which can be rotated about a rotation axis. In the operating state the fan unit 48 generates a fluid flow by means of the fan wheel. In the operating state the fan unit 48 circulates fluids present in the cooking chamber 16.

When viewed from the front, the fan unit 48 is arranged in a rear region of the cooking chamber 16. The fan unit 48 is arranged in proximity to the muffle rear wall 40.

The cooking appliance apparatus 10 has a cooking appliance rear wall 50. The cooking appliance rear wall 50 is arranged within the cooking chamber 16. When viewed from the front, the cooking appliance rear wall 50 is arranged in front of the fan unit 48. The cooking appliance rear wall 50 is arranged in proximity to the muffle rear wall 40.

The fan unit 48 is arranged in proximity to the heating element 18. When viewed from the front, the heating element 18 is arranged behind the cooking appliance rear wall 50. The heating element 18 is arranged in proximity to the muffle rear wall 40.

Figure 3:
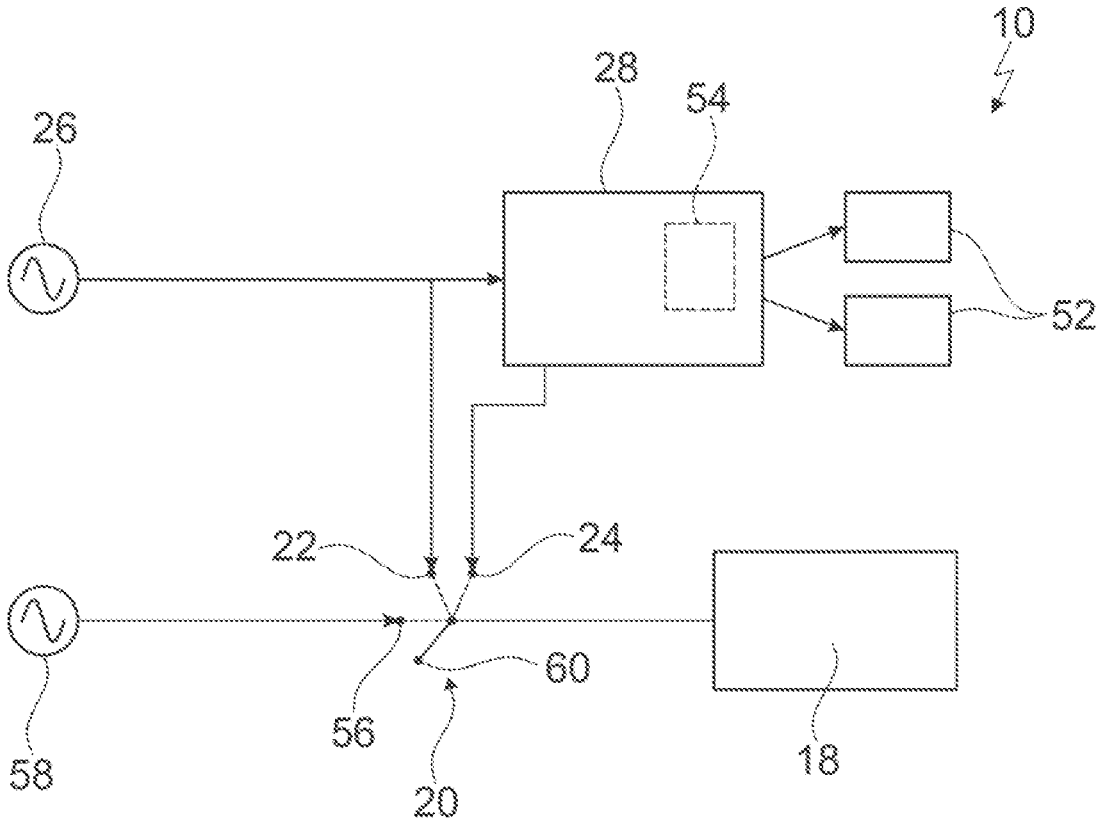
FIG. 3 shows a schematic view of the heating element, the further heating elements, a high-frequency power supply unit and a switching unit of the cooking appliance apparatus, as well as a phase and a further phase of a power supply network.

The cooking appliance apparatus 10 has a switching unit 20 (see FIG. 3). The switching unit 20 connects the heating element 18 to different supply voltages 22, 24, 56 in different operating states.

In a first operating state the switching unit 20 connects the heating element 18 to a first supply voltage 22. In the first operating state the heating element 18 could output for example a power of essentially 2.2 kW.

In a second operating state the switching unit 20 connects the heating element 18 to a second supply voltage 24, which is different from the first supply voltage 22. In the second operating state the heating element 18 could output for example a power of essentially 3.7 kW.

In the present exemplary embodiment the first supply voltage 22 and the second supply voltage 24 differ in respect of frequency in an operating state. The first supply voltage 22 is a network voltage supplied from a phase 26 of a power supply network. In the present exemplary embodiment the first supply voltage 22 has a frequency of essentially 50 Hz.

The cooking appliance apparatus 10 has a high-frequency power supply unit 28. The high-frequency power supply unit 28 supplies the second supply voltage 24. In the present exemplary embodiment the first supply voltage 22 has a frequency of at least 1 kHz.

The high-frequency power supply unit 28 has an inverter 54. Alternatively the high-frequency power supply unit 28 could in particular have a different number of inverters 54. For example the high-frequency power supply unit 28 could have at least two, in particular at least four, advantageously at least six and preferably a number of inverters 54.

In an operating state the inverter 54 supplies the frequency of at least 1 kHz. The inverter 54 is provided to supply the further heating element 52 configured as an induction heating element.

The further heating element 52 is connected to the high-frequency power supply unit 28 in an operating state. In the second operating state the heating element 18 and the further heating element 52 are connected to the high-frequency power supply unit 28.

In a third operating state the switching unit 20 connects the heating element 18 to a third supply voltage 56. The third supply voltage 56 is a further network voltage supplied from a further phase 58 of the power supply network. The phase 26 and the further phase 58 are different phases of the same power supply network. In the third operating state the heating element 18 could output a power of essentially 2.2 kW for example. In the third operating state the further heating element 52 could output a power of essentially 3.6 kW for example.

In a further operating state the switching unit 20 deactivates the heating element 18. The switching unit 20 connects the heating element 18 to a deactivation contact 60 in the further operating state. The heating element 18 is out of operation in the further operating state.

In a method for operating the cooking appliance apparatus 10 the cooking chamber 16 is partially heated by the heating element 18 in an operating state. In the present exemplary embodiment the cooking chamber 16 is heated partially by the further heating element 52 in an operating state. The heating element 18 is connected to the first supply voltage 22 in the first operating state and to the second supply voltage 24, which is different from the first supply voltage 22, in the second operating state.

The invention claimed is:

1. A cooking appliance apparatus, in particular an oven apparatus, comprising:

a muffle defining a cooking chamber;

a resistance heating element configured to heat the cooking chamber;

a switching unit configured to connect the resistance heating element to a first supply voltage in a first operating state wherein the resistance heating element is connected to a first phase of a power supply network, and to a second supply voltage in a second operating state, with the second supply voltage being different from the first supply voltage;

a high-frequency power supply unit configured to receive the first supply voltage and configured to supply the second supply voltage in the second operating state wherein the resistance heating element is connected to the high-frequency power supply unit, the first supply voltage being connected to the resistance heating element without passing through the high-frequency power supply unit by being connected to the first phase of the power supply network; and an induction heating element connected to the high-frequency power supply unit in an operating state, the switching unit is configured to connect the resistance heating element to a third supply voltage in a third operating state, and the third supply voltage is a further network voltage supplied from a second phase of the power supply network.

2. The cooking appliance apparatus of claim 1, wherein the first supply voltage and the second supply voltage differ at least in respect of frequency in at least one operating state.

3. The cooking appliance apparatus of claim 1, wherein the high-frequency power supply unit includes an inverter to supply the induction heating element.

4. The cooking appliance apparatus of claim 1, wherein the switching unit is configured to deactivate the resistance heating element in a further operating state.

5. A cooking appliance, in particular an oven, comprising:

a cooking appliance apparatus, said cooking appliance apparatus including:

a muffle defining a cooking chamber, a resistance heating element configured to heat the cooking chamber, a switching unit configured to connect the resistance heating element to a first supply voltage in a first operating state wherein the resistance heating element is connected to a first phase of a power supply network, and to a second supply voltage in a second operating state, with the second supply voltage being different from the first supply voltage, a high-frequency power supply unit configured to receive the first supply voltage and configured to supply the second supply voltage in the second operating state wherein the resistance heating element is connected to the high-frequency power supply unit, the first supply voltage being connected to the resistance heating element without passing through the high-frequency power supply unit by being connected to the first phase of the power supply network, and an induction heating element which is connected to the high-frequency power supply unit in an operating state, the switching unit is configured to connect the resistance heating element to a third supply voltage in a third operating state, and the third supply voltage is a further network voltage supplied from a second phase of the power supply network.

6. The cooking appliance of claim 5, wherein the first supply voltage and the second supply voltage differ at least in respect of frequency in at least one operating state.

7. The cooking appliance of claim 5, wherein the high-frequency power supply unit including an inverter to supply the induction heating element.

8. The cooking appliance of claim 5, wherein the switching unit is configured to deactivate the resistance heating element in a further operating state.

9. A method for operating a cooking appliance apparatus, comprising:

connecting, by a switching unit, a resistance heating element of the cooking appliance apparatus for heating a cooking chamber defined by a muffle of the cooking appliance apparatus to a first supply voltage in a first operating state wherein the resistance heating element is connected to a first phase of a power supply network, and to a second supply voltage in a second operating state, with the second supply voltage wherein the resistance heating element is connected to the high-frequency power supply unit, being different from the first supply voltage, wherein the high-frequency power supply unit receives the first supply voltage, which is a network voltage supplied from the first phase of a power supply network, and supplies the second supply voltage, and the first supply voltage is connected to the resistance heating element without passing through the high-frequency power supply unit by being connected to the first phase of the power supply network; and connecting an induction heating element to the high-frequency power supply unit in an operating state, the switching unit is configured to connect the resistance heating element to a third supply voltage in a third operating state, and the third supply voltage is a further network voltage supplied from a second phase of the power supply network.

10. The method of claim 9, wherein the resistance heating element is connected directly to the first supply voltage of the first phase of the power supply network by the switching unit.

11. The method of claim 10, wherein the resistance heating element is connected directly to the third supply voltage of the second phase of the power supply network by the switching unit.

12. The cooking appliance apparatus of claim 5, wherein the resistance heating element is connected directly to the first supply voltage of the first phase of the power supply network by the switching unit.

13. The cooking appliance apparatus of claim 12, wherein the resistance heating element is connected directly to the third supply voltage of the second phase of the power supply network by the switching unit.

14. The cooking appliance apparatus of claim 1, wherein the resistance heating element is connected directly to the first supply voltage of the first phase of the power supply network by the switching unit.

15. The cooking appliance apparatus of claim 14, wherein the resistance heating element is connected directly to the third supply voltage of the second phase of the power supply network by the switching unit.

* * * * *